US009728872B2

(12) United States Patent
Sun et al.

(10) Patent No.: US 9,728,872 B2
(45) Date of Patent: Aug. 8, 2017

(54) CONNECTOR PLUG, CONNECTOR SOCKET, AND CONNECTOR

(71) Applicant: Xiaomi Inc., Beijing (CN)

(72) Inventors: Wei Sun, Beijing (CN); Xinming Shi, Beijing (CN); Hao Di, Beijing (CN)

(73) Assignee: Xiaomi Inc, Beijing (CN)

( * ) Notice: Subject to any disclaimer, the term of this patent is extended or adjusted under 35 U.S.C. 154(b) by 0 days.

(21) Appl. No.: 14/949,062

(22) Filed: Nov. 23, 2015

(65) Prior Publication Data

US 2016/0087364 A1 Mar. 24, 2016

Related U.S. Application Data

(63) Continuation-in-part of application No. PCT/CN2015/075027, filed on Mar. 25, 2015.

(30) Foreign Application Priority Data

Sep. 22, 2014 (CN) ..... 2014 1 0488152

(51) Int. Cl.
*H01R 24/00* (2011.01)
*H01R 12/71* (2011.01)
*H01R 12/70* (2011.01)

(52) U.S. Cl.
CPC ..... *H01R 12/716* (2013.01); *H01R 12/7076* (2013.01)

(58) Field of Classification Search
CPC . H01R 12/716; H01R 13/631; H01R 12/7076
USPC ..... 439/74, 65, 69, 374
See application file for complete search history.

(56) References Cited

U.S. PATENT DOCUMENTS 5,181,855 A * 1/1993 Mosquera ..... H01R 13/28 439/291
5,904,581 A * 5/1999 Pope ..... H01R 12/716 439/74
5,921,787 A * 7/1999 Pope ..... H01R 12/85 439/660
6,048,213 A * 4/2000 Lai ..... H01R 12/716 439/660

(Continued)

FOREIGN PATENT DOCUMENTS

CN 101587994 A 11/2009
CN 201956497 U 8/2011

(Continued)

OTHER PUBLICATIONS

International Search Report for International Application No. PCT/CN2015/075027 dated Jun. 30, 2015.

(Continued)

*Primary Examiner* — Tulsidas C Patel
*Assistant Examiner* — Peter G Leigh

(57) ABSTRACT

In the connector, a plurality of parallel flanges and groove pins between every two of the parallel flanges are additionally provided to the middle of the connector plug. A plurality of parallel grooves and flange pins between every two of the parallel grooves are additionally provided to the middle of the connector socket. The plurality of flanges of the connector plug are inserted into the plurality of grooves of the connector socket. The mating face of the connector plug is in contact with the mating face of the connector socket.

20 Claims, 3 Drawing Sheets

(56) References Cited

U.S. PATENT DOCUMENTS

| | | | | | |
|---|---|---|---|---|---|
| 6,068,518 | A * | 5/2000 | McEuen | H01R 12/727 | 439/284 |
| 6,135,781 | A * | 10/2000 | Pope | H01R 12/716 | 439/59 |
| 6,764,314 | B1 * | 7/2004 | Lee | H01R 12/57 | 439/65 |
| 7,004,763 | B2 * | 2/2006 | Ma | H01R 12/52 | 439/636 |
| 7,261,601 | B1 * | 8/2007 | Chen | H01R 12/716 | 439/660 |
| 7,591,669 | B1 | 9/2009 | Peng | | |
| 7,833,024 | B2 * | 11/2010 | Takeuchi | H01R 13/432 | 439/74 |
| 8,500,459 | B2 * | 8/2013 | Niitsu | H01R 23/68 | 439/74 |
| 8,708,714 | B2 * | 4/2014 | Niitsu | H01R 12/716 | 439/660 |
| 9,257,778 | B2 * | 2/2016 | Buck | H01R 13/516 | |
| 9,356,407 | B2 * | 5/2016 | Nakamura | H01R 24/68 | |
| 2007/0117416 | A1 | 5/2007 | Peterson et al. | | |
| 2007/0264854 | A1 * | 11/2007 | Sasaki | H01R 13/20 | 439/188 |
| 2013/0260587 | A1 * | 10/2013 | Chen | H01R 12/712 | 439/284 |
| 2014/0193992 | A1 | 7/2014 | Fang et al. | | |

FOREIGN PATENT DOCUMENTS

| | | | |
|---|---|---|---|
| CN | 102769218 | A | 11/2012 |
| CN | 103022839 | A | 4/2013 |
| CN | 203218516 | U | 9/2013 |
| CN | 103427238 | A | 12/2013 |
| CN | 103915723 | A | 7/2014 |
| GB | 2344701 | A | 6/2000 |
| JP | 10-022013 | A | 1/1998 |
| JP | 10-162914 | A | 6/1998 |
| JP | 11-329603 | A | 11/1999 |
| JP | 2001085088 | A | 3/2001 |
| JP | 2007088296 | A | 4/2007 |
| JP | 2007242383 | A | 9/2007 |
| KR | 1019950034930 | | 10/1995 |
| KR | 20080023893 | A | 3/2008 |
| KR | 20100121261 | A | 11/2010 |
| WO | WO2008109169 | A1 | 9/2008 |

OTHER PUBLICATIONS

Office Action for Korean application 044264429 dated Jun. 20, 2016.

Office Action for Japanese application 2016-549620 dated Sep. 29, 2016.

European Search Report for Application No. EP 15178929 dated Dec. 9, 2015.

Office Action for Chinese application 201410488152.0 dated Dec. 29, 2015.

Notice of Allowance corresponding to KR application 1019950034930 dated Dec. 22, 2016.

Office Action and English translation for Japanese Application No. 2016-549620 dated May 16, 2017, 4 pages.

* cited by examiner

CONNECTOR PLUG, CONNECTOR SOCKET, AND CONNECTOR

CROSS-REFERENCE TO RELATED APPLICATIONS

This application is a continuation-in-part application of International Application No. PCT/CN2015/075027, filed Mar. 25, 2015, which is based upon and claims priority to Chinese Patent Application No. CN201410488152.0, filed Sep. 22, 2014, the entire contents of all of which are incorporated herein by reference.

TECHNICAL FIELD

The present disclosure relates to the field of connectors, and more particularly, to a connector plug, a connector socket and a connector.

BACKGROUND

A connector is usually composed of a plug and a socket. Connecting or disconnecting a circuit may be realized by engagement or disengagement of the plug and the socket.

In the related art, one flange is disposed in the middle of the plug, and a row of pins is disposed on either side of the flange respectively, i.e. two rows of pins. One groove is disposed in the middle of the socket, and a row of pins is disposed on either side of the groove respectively, i.e. two rows of pins. When the plug is inserted into the socket, the flange will be inserted into the groove, and two rows of pins of the plug will be connected with two rows of pins of the socket correspondingly.

SUMMARY

According to a first aspect of embodiments of the present disclosure, a connector plug is provided. The connector plug includes a plug body having a mating face. The connector plug further includes a plurality of parallel flanges disposed in the middle of the mating face, where one groove is disposed between every two adjacent flanges of the n parallel flanges. An array of groove pins are disposed on groove faces of the groove. The connector plug further includes a left array of pins and a right array of pins are respectively disposed on either side of the n parallel flanges, both the left array of pins and the right array of pins being attached to the mating face.

According to a second aspect of embodiments of the present disclosure, a connector socket is provided. The connector socket includes: a socket body having a mating face; a plurality of parallel grooves, and a left array of pins and a right array of pins. The plurality of parallel grooves are disposed in a middle of the mating face, where one flange is disposed between every two adjacent grooves of the n parallel grooves, and an array of flange pins are disposed on flange faces of the flange. The left array of pins and the right array of pins are respectively disposed on either side of the n parallel grooves, both the left array of pins and the right array of pins being attached to the mating face.

According to a third aspect of the embodiments of the present disclosure, a connector is provided. The connector includes: the connector plug provided by the above first aspect; and the connector socket provided by the above second aspect.

In another aspect, n flanges of the connector plug are inserted into n grooves of the connector socket; and the mating face of the connector plug is in contact with the mating face of the connector socket.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

Specific embodiments in this disclosure have been shown by way of example in the foregoing drawings and are hereinafter described in detail. The figures and written description are not intended to limit the scope of the inventive concepts in any manner. Rather, they are provided to illustrate the inventive concepts to a person skilled in the art with reference to particular embodiments.

DESCRIPTION OF THE EMBODIMENTS

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of devices and methods consistent with aspects associated to the invention as recited in the appended claims.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Figure 1:
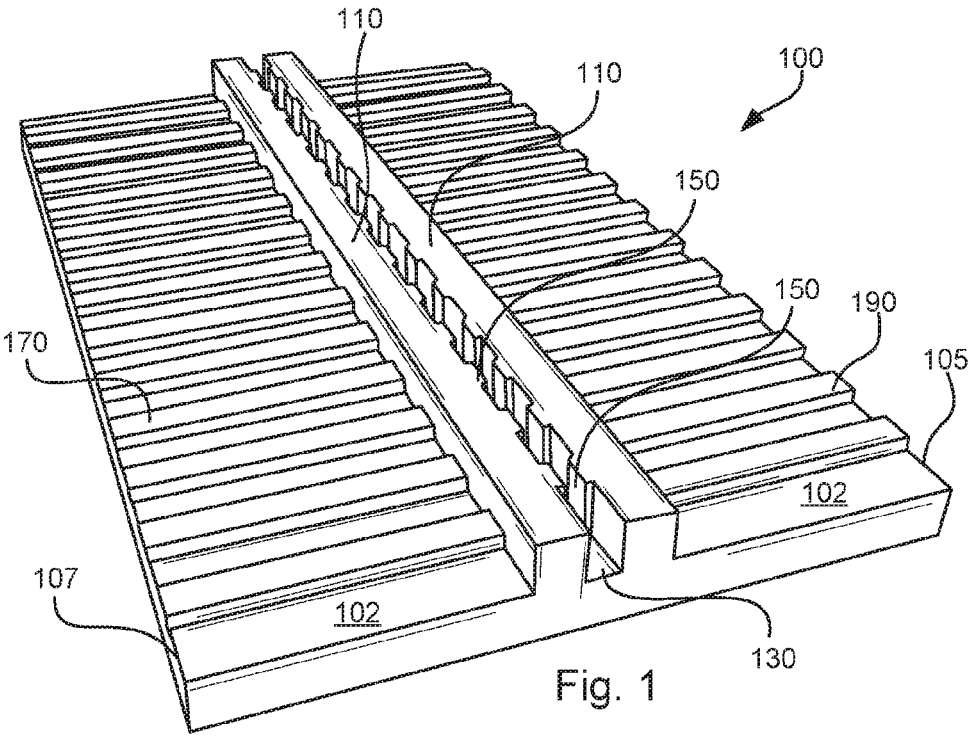
FIG. 1 is a structural diagram of a connector plug according to exemplary embodiments.

FIG. 1 is a structural diagram of a connector plug according to exemplary embodiments. The connector plug includes: a plug body 100 having a mating face 102 with a left outer side edge 107 and a right outer side edge 105.

Two parallel flanges 110 are disposed in the middle of the mating face 102, one groove 130 is disposed between the two parallel flanges, and an array 150 of groove pins are disposed on groove faces of the groove.

A left array 170 of pins and a right array 190 of pins are respectively disposed on either side of the two parallel flanges. Both the left array170 of pins and the right array 190 of pins are attached to the mating face 102. The left array of pins 170 and the right array of pins 190 extend from the middle of the mating face 102 to respectively stop at the left outer side edge 107 and the right outer side edge 105.

Accordingly, in the connector plug provided by the present embodiment, the flange in the middle of the mating face 102 are divided into two parallel flanges; the groove disposed between every two adjacent flanges is provided with an array of groove pins. Thus, it may solve the problem that the length of the connector has to be increased when the number of pins is to be increased for the connector, which results in a larger volume of the connector and makes a miniaturized scale of devices in the electronic equipment impossible. The disclosed connectors may achieve the effect that even though the length of the connector is not increased, the number of pins may be nevertheless increased by additionally providing an array of groove pins on the groove faces of the groove, thus improving the reliability of the connector.

Figure 2:
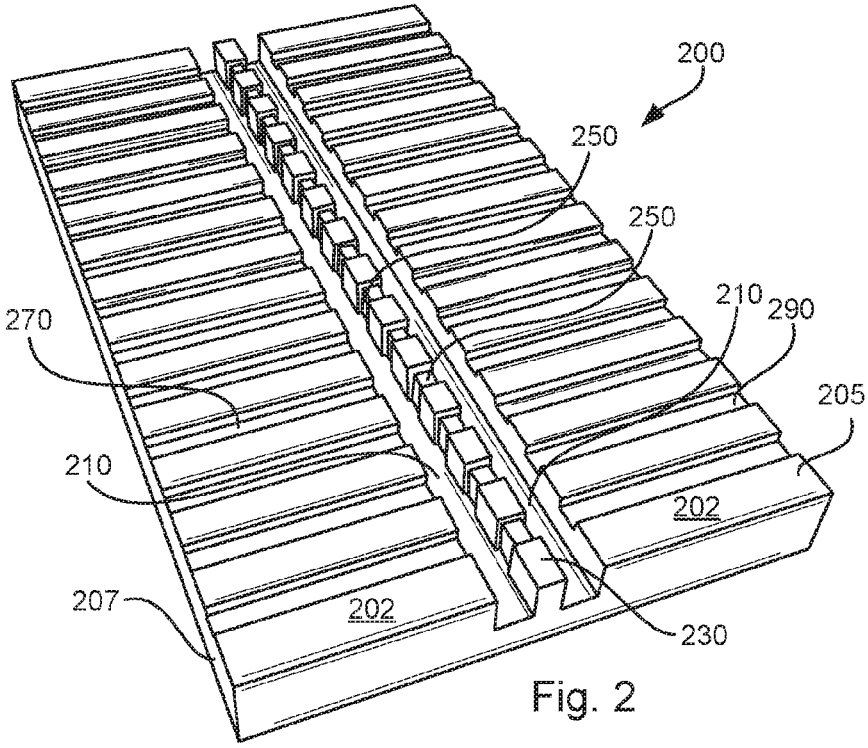
FIG. 2 is a structural diagram of a connector socket according to exemplary embodiments.

FIG. 2 is a structural diagram of a connector socket according to exemplary embodiments. The connector socket includes: a socket body 200 having a mating face 202 with a left outer side edge 207 and a right outer side edge 205.

Two parallel grooves 210 are disposed in the middle of the mating face 202, one flange 230 is disposed between the two parallel flanges, and an array 250 of flange pins are disposed on flange faces of the flange.

A left array 270 of pins and a right array 290 of pins are respectively disposed on both sides of the two parallel grooves. Both the left array 270 of pins and the right array 290 of pins are attached to the mating face 202. The left array of pins 270 and the right array of pins 290 extend from the middle of the mating face 202 to respectively stop at the left outer side edge 207 and the right outer side edge 205.

Two parallel grooves 210 are disposed in the middle of the mating face, one flange 230 is disposed between the two parallel flanges, and an array 250 of flange pins are disposed on flange faces of the flange.

A left array 270 of pins and a right array 290 of pins are respectively disposed on both sides of the two parallel grooves. Both the left array 270 of pins and the right array 290 of pins are attached to the mating face.

Accordingly, in the connector socket provided by the present embodiment, the groove in the middle of the mating face is divided into two parallel grooves. The flange disposed between every two adjacent grooves is provided with an array of flange pins. Thus, the disclosed socket solves the problem that the length of the connector has to be increased when the number of pins is to be increased for the connector, which results in a larger volume of the connector and makes a miniaturized scale of devices in the electronic equipment impossible. It may achieve the effect that even though the length of the connector is not increased, the number of pins may be nevertheless increased by additionally providing an array of flange pins on the flange faces of the flange, thus improving the reliability of the connector.

Figure 3:
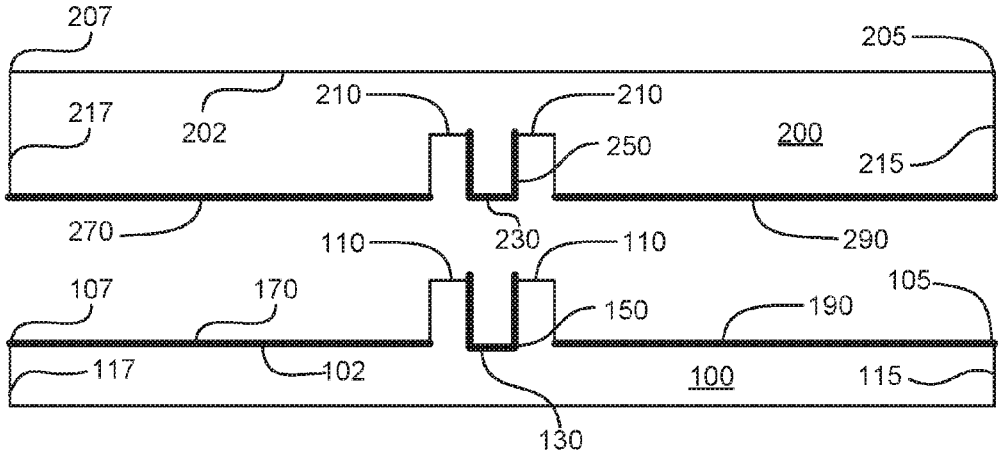
FIG. 3 is a cross sectional view of a connector according to exemplary embodiments.

FIG. 3 is a cross sectional view of a connector according to exemplary embodiments. The connector includes: the connector plug 100 and the connector socket 200. The connector plug 100 has a left side surface 117 that intersects with the plug mating face 102 at the left outer side edge 107. The connector plug 100 has a right side surface 115 that intersects with the plug mating face 102 at the right outer side edge 105. Similarly, the connector socket 200 has a left side surface 217 that intersects with the socket mating face 202 at the left outer side edge 207. The connector socket 200 has a right side surface 215 that intersects with the socket mating face 202 at the right outer side edge 205.

In an aspect, the connector plug 100 includes: a plug body having a mating face and a plurality of flanges. The plurality of flanges may include n parallel flanges disposed in the middle of the mating face, where n is a natural number no less than 2. For example, in the present embodiment, n equals to 2. That is, the connector plug includes two parallel flanges 110 disposed in the middle of the mating face. One groove 130 is disposed between the two parallel flanges. An array 150 of groove pins is disposed on groove faces of the groove 130.

Referring to FIG. 1, the array 150 of groove pins includes m groove pins arranged regularly along the groove 130, m being a natural number greater than 2. When the groove 130 has three groove faces, i.e. left, right and bottom groove faces, each groove pin covers portions of the three groove faces, so as to obtain an excellent electrical contact.

A left array 170 of pins and a right array 190 of pins are disposed respectively on both sides of the two parallel flanges 110. Both the left array 170 of pins and the right array 190 of pins are attached to the mating face.

The left array 170 of pins includes m left pins provided correspondingly to the groove pins, and the left pins are parallel to each other and perpendicular to the flange 110.

The right array of pins 190 includes m right pins provided correspondingly to the groove pins, and the right pins are parallel to each other and perpendicular to the flange 110.

In addition, a bottom of the groove 130 is in the same plane as the mating face.

In another aspect, the connector socket 200 may include: a socket body having a mating face 202 and a plurality of parallel grooves disposed in the middle of the mating face 202. For example, the connector socket may include two parallel grooves 210 disposed in the middle of the mating face 202. One flange 230 is disposed between the two parallel grooves 210. An array 250 of flange pins is disposed on a flange face of the flange 230. When the flange 230 has three flange faces, i.e. left, right and bottom flange faces, each flange pin covers portions of the three flange faces, so as to obtain an excellent electrical contact.

A left array 270 of pins and a right array 290 of pins are respectively disposed on both sides of the two parallel grooves 210. Both the left array 270 of pins and the right array 290 of pins are attached to the mating face 202.

Referring to FIG. 2, the left array 270 of pins includes m left pins provided correspondingly to the flange pins, and the left pins are parallel to each other and perpendicular to the groove 210.

The right array 290 of pins includes m right pins provided correspondingly to the flange pins, and the right pins are parallel to each other and perpendicular to the groove 210.

In addition, a top of the flange 230 is in the same plane as the mating face.

The connector plug 100 and the connector socket 200 are engaged in the following manner:

n flanges 110 of the connector plug 100 are inserted into n grooves 210 of the connector socket 200.

In the present embodiment, the connector plug 100 has two flanges 110, and the connector socket 200 has two grooves 210. The two flanges 110 of the connector plug 100 are inserted into the two grooves 210 of the connector socket 200.

The mating face of the connector plug 100 is in contact with the mating face of the connector socket 200.

At this time, the m groove pins corresponding to the groove between the first flange and the second flange of the connector plug 100 are correspondingly electrically connected with the m flange pins corresponding to the flange between the first groove and the second groove of the connector socket 200; the m left pins of the connector plug 100 are correspondingly electrically connected with the m left pins of the connector socket 200; and the m right pins of the connector plug 100 are correspondingly electrically connected with the m right pins of the connector socket 200.

Accordingly, in the connector provided by the present embodiment, n parallel flanges and groove pins between every two of the n parallel flanges are additionally provided to the middle of the connector plug; n parallel grooves and flange pins between every two of the n parallel grooves are additionally provided to the middle of the connector socket; the n flanges of the connector plug are inserted into n grooves of the connector socket; and the mating face of the connector plug is in contact with the mating face of the connector socket. Thus, it may solve the problem that the length of the connector has to be increased when the number of pins is to be increased for the connector, which results in a larger volume of the connector and makes a miniaturized scale of devices in the electronic equipment impossible; and it may achieve the effect that even though the length of the connector is not increased, the number of pins may be nevertheless increased, thus improving the reliability of the connector.

In the connector provided by the present embodiment, the array of groove pins of the connector plug includes m groove pins arranged regularly along the groove; and the array of flange pins of the connector socket includes m flange pins arranged regularly along the flange. Thus, it be achieved the effect of additionally providing m pins, i.e. additionally providing a row of pins.

In the above embodiment, n=2 for example, but in different embodiments, n may be greater than 2. At this time, the connector may be additionally provided with n−1 arrays of pins, each pin array including m pins. In the following embodiment, n=3 for example.

Figure 4:
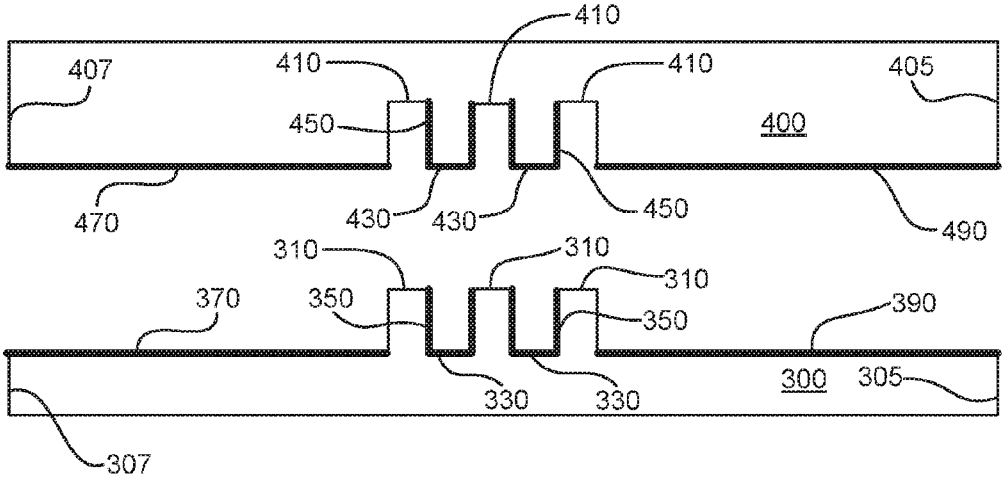
FIG. 4 is a cross sectional view of a connector according to exemplary embodiments.

FIG. 4 is a cross sectional view of a connector according to another exemplary embodiment. The connector includes: the connector plug 300 and the connector socket 400.

In an aspect, the connector plug 300 includes:

a plug body having a mating face; and n parallel flanges disposed in the middle of the mating face, n≥2, and in the present embodiment, n=3. That is, in the present embodiment, the connector plug includes three parallel flanges 310 disposed in the middle of the mating face, one groove 330 is disposed between every two adjacent flanges of the three parallel flanges, and an array 350 of groove pins is disposed on groove faces of each groove 330. When each groove 330 has three groove faces, i.e. left, right and bottom groove faces, each groove pin covers portions of the three groove faces, so as to obtain an excellent electrical contact.

For example, the array 350 of groove pins includes m groove pins arranged regularly along the groove, m being a natural number.

A left array 370 of pins and a right array 390 of pins are respectively disposed on both sides of the three parallel flanges 310. Both the left array 370 of pins and the right array 390 of pins are attached to the mating face.

In the embodiment, the left array 370 of pins includes m left pins provided correspondingly to the groove pins, and the left pins are parallel to each other and perpendicular to the flanges 310.

The right array of pins 390 includes m right pins provided correspondingly to the groove pins, and the right pins are parallel to each other and perpendicular to the flanges 310.

For example, a bottom of the groove is in the same plane as the mating face.

In another aspect, the connector socket 400 includes:

a socket body having a mating face;

n parallel grooves disposed in the middle of the mating face, n≥2, and in the present embodiment, n=3. That is, the connector socket includes three parallel grooves 410 disposed in the middle of the mating face. One flange 430 is disposed between every two adjacent grooves of the three parallel grooves, and an array of flange pins 450 is disposed on a flange face of each flange 430. When each flange 430 has three flange faces, i.e. left, right and bottom flange faces, each flange pin covers portions of the three flange faces, so as to obtain an excellent electrical contact.

A left array 470 of pins and a right array 490 of pins are respectively disposed on both sides of the three parallel grooves. Both the left array of pins 470 and the right array of pins 490 are attached to the mating face.

In the embodiment, the left array 470 of pins includes m left pins provided correspondingly to the flange pins, and the left pins are parallel to each other and perpendicular to the grooves 410.

The right array 490 of pins includes m right pins provided correspondingly to the flange pins, and the right pins are parallel to each other and perpendicular to the grooves 410.

In the embodiment, a top of the flange 430 is in the same plane as the mating face.

The connector plug 300 and the connector socket 400 may be engaged in the following manner: n flanges 310 of the connector plug 300 are inserted into n grooves 410 of the connector socket 400.

In the present embodiment, the connector plug 300 has three flanges; the connector socket 400 has three grooves. The three flanges of the connector plug 300 are inserted into the three grooves of the connector socket 400.

The mating face of the connector plug 300 is in contact with the mating face of the connector socket 400.

That is, the m groove pins corresponding to the first groove between the first flange and the second flange of the connector plug 300 are correspondingly electrically connected with the m flange pins corresponding to the first flange between the first groove and the second groove of the connector socket 400.

The m groove pins corresponding to the second groove between the second flange and the third flange of the connector plug 300 are correspondingly electrically connected with the m flange pins corresponding to the second flange between the second groove and the third groove of the connector socket 400.

The m left pins of the connector plug 300 are correspondingly electrically connected with the m left pins of the connector socket 400; and the m right pins of the connector plug 300 are correspondingly electrically connected with the m right pins of the connector socket 400.

In the connector provided by the present embodiment, n parallel flanges and groove pins between every two of the n parallel flanges are additionally provided to the middle of the connector plug; n parallel grooves and flange pins between every two of the n parallel grooves are additionally provided to the middle of the connector socket; the n flanges of the connector plug are inserted into n grooves of the connector socket; and the mating face of the connector plug is in contact with the mating face of the connector socket. Thus, it may solve the problem that the length of the connector has to be increased when the number of pins is to be increased for the connector, which results in a larger volume of the connector and makes a miniaturized scale of devices in the electronic equipment impossible; and it may achieve the effect that even though the length of the connector is not increased, the number of pins may be nevertheless increased, thus improving the reliability of the connector.

In the connector provided by the present embodiment, each array of groove pins of the connector plug includes m groove pins arranged regularly along each groove; and each array of flange pins of the connector socket includes m flange pins arranged regularly along each flange. Thus, it be achieved the effect of additionally providing 2 m pins, i.e. additionally providing two rows of pins.

It will be obvious for those skilled in the art on the basis of the above two embodiments to anticipate embodiments where n is another numerical value, and the detailed description will not be repeated herein.

Figure 5:
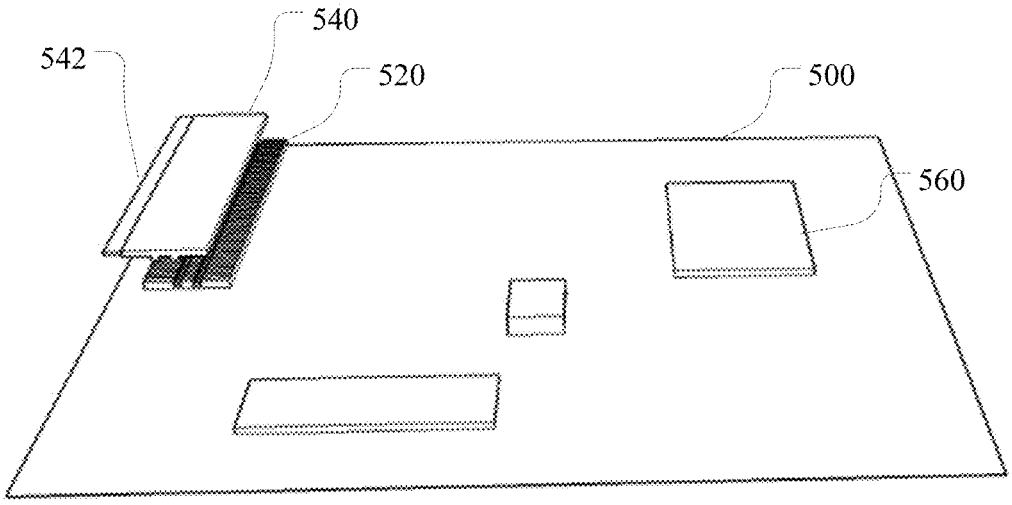
FIG. 5 illustrates a printed circuit board (PCB) that includes a connector according to exemplary embodiments.

FIG. 5 illustrates a printed circuit board (PCB) 500 that includes a connector according to exemplary embodiments. The PCB 500 includes a connector socket 520, which is electronically connected to conductive traces in the PCB 500. For example, each pin of the connector socket 520 may be connected to different conductive traces in the PCB 500. The PCB 500 may also include other electronic device 560, which may include controllers, processors, memories, or any other type of chips. The electronic device 560 may be connected to the connector socket 520 via a conductive line in the PCB 500. For example, each control pin of the electronic device 560 may be connected to each connector pin on the chip socket 520 through a conductive circuitry line.

A connector plug 540 outside of the PCB 500 may be plugged into the connector socket 520. Alternatively or additionally, one side of the connector plug 540 is provided with a cable 542, which may be connected to an external electronic device. For example, the external electronic device may be controlled by chips on the PCB 500. After the connector plug 540 is plugged into the connector 520, the external electronic device is electrically connected with the control chip.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims. The different exemplary embodiments in the disclosure may be combined to create new embodiment without undue experiments by a person having ordinary skill in the art.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A connector plug, comprising:

a plug body having a mating face with a left outer side edge and a right outer side edge;

a plurality of parallel flanges disposed in a middle of the mating face, one groove being disposed between every two adjacent flanges of the plurality of parallel flanges, and an array of groove pins being disposed on groove faces of the groove; and a left array of pins and a right array of pins respectively disposed on either side of the plurality of parallel flanges, both the left array of pins and the right array of pins being attached to the mating face, wherein the left array of pins and the right array of pins extend from the middle of the mating face to respectively stop at the left outer side edge and the right outer side edge.

2. The connector plug according to claim 1, wherein the array of groove pins comprises m groove pins arranged regularly along the groove, m being a natural number.

3. The connector plug according to claim 2, wherein the left array of pins comprises m left pins provided correspondingly to the groove pins, the left pins being parallel to each other and perpendicular to the flanges; and wherein the right array of pins comprises m right pins provided correspondingly to the groove pins, the right pins being parallel to each other and perpendicular to the flanges.

4. The connector plug according to claim 1, wherein a bottom of the groove is in a same plane as the mating face.

5. The connector plug according to claim 1, wherein a width of the left array of pins is greater than a depth of the groove.

6. The connector plug according to claim 3, wherein a bottom of the groove is in a same plane as the mating face.

7. A connector socket, comprising:

a socket body having a mating face with a left outer side edge and a right outer side edge;

a plurality of parallel grooves disposed in a middle of the mating face, one flange being disposed between every two adjacent grooves of the plurality of parallel grooves, and an array of flange pins being disposed on flange faces of the flange; and a left array of pins and a right array of pins respectively disposed on either side of the plurality of parallel grooves, both the left array of pins and the right array of pins being attached to the mating face, wherein the left array of pins and the right array of pins extend from the middle of the mating face to respectively stop at the left outer side edge and the right outer side edge.

8. The connector socket according to claim 7, wherein the array of flange pins comprises m flange pins arranged regularly along the flange, m being a natural number.

9. The connector socket according to claim 8, wherein the left array of pins comprises m left pins provided correspondingly to the flange pins, the left pins being parallel to each other and perpendicular to the grooves; and wherein the right array of pins comprises m right pins provided correspondingly to the flange pins, the right pins being parallel to each other and perpendicular to the grooves.

10. The connector socket according to claim 7, wherein a top of the flange is in a same plane as the mating face.

11. The connector socket according to claim 8, wherein a top of the flange is in a same plane as the mating face.

12. The connector socket according to claim 9, wherein a top of the flange is in a same plane as the mating face.

13. A connector, comprising:

a connector plug comprising: a plug body having a mating face with a left outer side edge and a right outer side edge; a plurality of parallel flanges disposed in a middle of the mating face, one groove being disposed between every two adjacent flanges of the plurality of parallel flanges, and an array of groove pins being disposed on groove faces of the groove; and a left array of pins and a right array of pins respectively disposed on either side of the plurality of parallel flanges, both the left array of pins and the right array of pins being attached to the mating face; and a connector socket configured to receive at least one of the plurality of parallel flanges.

14. The connector according to claim 13, wherein the plurality of flanges of the connector plug are inserted into a plurality of grooves of the connector socket; and wherein the mating face of the connector plug is in contact with the mating face of the connector socket.

15. The connector according to claim 13, wherein the left array of pins comprises m left pins provided correspondingly to the groove pins, the left pins being parallel to each other and perpendicular to the flanges; and wherein the right array of pins comprises m right pins provided correspondingly to the groove pins, the right pins being parallel to each other and perpendicular to the flanges.

16. The connector according to claim 13, wherein the array of flange pins comprises m flange pins arranged regularly along the flange, m being a natural number.

17. The connector according to claim 13, wherein the left array of pins comprises m left pins provided correspondingly to the flange pins, the left pins being parallel to each other and perpendicular to the grooves; and wherein the right array of pins comprises m right pins provided correspondingly to the flange pins, the right pins being parallel to each other and perpendicular to the grooves.

18. The connector according to claim 13, wherein a top of the flange is in a same plane as the mating face.

19. The connector according to claim 13, wherein the left array of pins and the right array of pins extend from the middle of the mating face to respectively stop at the left outer side edge and the right outer side edge.

20. The connector according to claim 15, wherein a top of the flange is in a same plane as the mating face.

* * * * *